US007597154B1

(12) United States Patent
McFarland et al.

(10) Patent No.: US 7,597,154 B1
(45) Date of Patent: Oct. 6, 2009

(54) TORQUE TUBE WITH SLIDE OUT CAGE SYSTEM

(76) Inventors: David L. McFarland, 8191 130$^{th}$ Ave., SE., Gwinner, ND (US) 58040; Clayton A. Melrose, 405 S. 11$^{th}$ St., Oakes, ND (US) 58474

( * ) Notice: Subject to any disclaimer, the term of this patent is extended or adjusted under 35 U.S.C. 154(b) by 208 days.

(21) Appl. No.: 11/194,073

(22) Filed: Jul. 29, 2005

(51) Int. Cl.
*A01D 19/00* (2006.01)

(52) U.S. Cl. ..... 171/143

(58) Field of Classification Search ..... 171/143
See application file for complete search history.

(56) References Cited

U.S. PATENT DOCUMENTS

| | | | | | |
|---|---|---|---|---|---|
| 1,578,600 | A | | 3/1926 | Greatrix | 171/101 |
| 2,882,977 | A | * | 4/1959 | Smith et al. | 172/15 |
| 3,103,076 | A | * | 9/1963 | Schultz | 37/303 |
| 3,879,786 | A | * | 4/1975 | Larkin | 15/88.3 |
| 4,041,996 | A | * | 8/1977 | Grover | 144/24.12 |
| RE29,957 | E | * | 4/1979 | Kasper | 15/83 |
| 4,329,792 | A | * | 5/1982 | Berner | 37/246 |
| 4,512,413 | A | * | 4/1985 | Hirata et al. | 172/74 |
| 5,011,442 | A | * | 4/1991 | Polcz et al. | 440/113 |
| 5,160,034 | A | * | 11/1992 | Potter | 209/38 |
| 5,231,725 | A | * | 8/1993 | Hennessey et al. | 15/83 |
| 5,369,832 | A | * | 12/1994 | Hagger | 15/83 |
| 5,382,084 | A | * | 1/1995 | Diver et al. | 299/39.5 |
| 6,094,847 | A | | 8/2000 | Gallenberg | 37/422 |
| 6,540,030 | B2 | | 4/2003 | Ohzeki et al. | 171/1 |
| 6,634,434 | B2 | | 10/2003 | Ohzeki et al. | 171/63 |
| 6,640,906 | B2 | | 11/2003 | Ohzeki et al. | 171/65 |
| 6,805,204 | B2 | | 10/2004 | Bauer et al. | 171/111 |
| 7,284,625 | B2 | * | 10/2007 | Jones | 180/53.4 |
| 2006/0162103 | A1 | * | 7/2006 | Kallman et al. | 15/82 |
| 2006/0243463 | A1 | * | 11/2006 | Mensch | 172/245 |

* cited by examiner

*Primary Examiner*—Thomas B Will
*Assistant Examiner*—Joel F Mitchell
(74) *Attorney, Agent, or Firm*—Michael S. Neustel

(57) ABSTRACT

A torque tube with slide out cage system for providing both structural support to the frame of the machine and a protective area for sensitive control systems for the machine. The torque tube with slide out cage system includes a torque tube attached between a first side and a second side of a frame, a side opening within the frame exposing the lumen of the torque tube, and a cage slidably positioned within the torque tube. The cage is capable of supporting various types of control systems such as a valve box, hydraulic systems and electronics.

10 Claims, 8 Drawing Sheets

TORQUE TUBE WITH SLIDE OUT CAGE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to machines for cleaning ground surfaces and more specifically it relates to a torque tube with slide out cage system for providing both structural support to the frame of the machine and a protective area for sensitive control systems for the machine.

2. Description of the Related Art

Any discussion of the prior art throughout the specification should in no way be considered as an admission that such prior art is widely known or forms part of common general knowledge in the field.

Ground surface cleaning machines have been in use for years for cleaning debris (e.g. rocks, sticks, bottles, cans, paper, etc.) from various types of ground surfaces (e.g. sand, dirt). Such ground surface cleaning machines are typically self-powered and relatively expensive. However, there have been proposed ground surface cleaning machines that are attached to an existing tractor to receive their operational power. Examples of such ground surface cleaning machines are illustrated in U.S. Pat. No. 6,094,847 to Gallenberg (Beach Cleaning Apparatus and Method), U.S. Pat. No. 1,578,600 to Greatrix (Combined Stone and Root Gatherer), U.S. Pat. No. 6,805,204 to Bauer (Vehicle, Especially for Beach Cleaning), U.S. Pat. No. 6,540,030 to Ohzeki (Method for Recovering Waste in Sandy Beach), U.S. Pat. No. 6,640,906 to Ohzeki (Beach Cleaner) and U.S. Pat. No. 6,634,434 to Ohzeki (Beach Cleaner).

Conventional ground surface cleaning machines have a frame typically having a pair of opposing side portions with a plurality of cross members extending between the side portions. Conventional ground surface cleaning machines further typically include one or more chains supported upon rollers that provide for the movement and cleaning of the ground surface. Control systems (e.g. hydraulic motors, valve blocks, electronics, etc.) are attached to the frame and are therefore susceptible to damage from moving debris (e.g. rocks) created via the cleaning action of the machine.

The torque tube with slide out cage system according to the present invention substantially departs from the conventional concepts and designs of the prior art, and in so doing provides an apparatus primarily developed for the purpose of providing both structural support to the frame of the machine and a protective area for sensitive control systems for the machine.

BRIEF SUMMARY OF THE INVENTION

In view of the foregoing disadvantages inherent in the known types of ground surface cleaning machines now present in the prior art, the present invention provides a new torque tube with slide out cage system construction wherein the same can be utilized for providing both structural support to the frame of the machine and a protective area for sensitive control systems for the machine.

The general purpose of the present invention, which will be described subsequently in greater detail, is to provide a new torque tube with slide out cage system that has many of the advantages of the ground surface cleaning machines mentioned heretofore and many novel features that result in a new torque tube with slide out cage system which is not anticipated, rendered obvious, suggested, or even implied by any of the prior art ground surface cleaning machines, either alone or in any combination thereof.

To attain this, the present invention generally comprises a torque tube attached between a first side and a second side of a frame, a side opening within the frame exposing the lumen of the torque tube, and a cage slidably positioned within the torque tube. The cage is capable of supporting various types of control systems such as a valve box, hydraulic systems and electronics.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a torque tube with slide out cage system that will overcome the shortcomings of the prior art devices.

A second object is to provide a torque tube with slide out cage system for providing both structural support to the frame of the machine and a protective area for sensitive control systems for the machine.

Another object is to provide a torque tube with slide out cage system that protects various types of control systems for a ground surface cleaning machine (e.g. hydraulic systems, electrical system).

An additional object is to provide a torque tube with slide out cage system that provides convenient access to various types of control system for a ground surface cleaning machine.

A further object is to provide a torque tube with slide out cage system that reduces damage to control systems within a ground surface cleaning machine.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
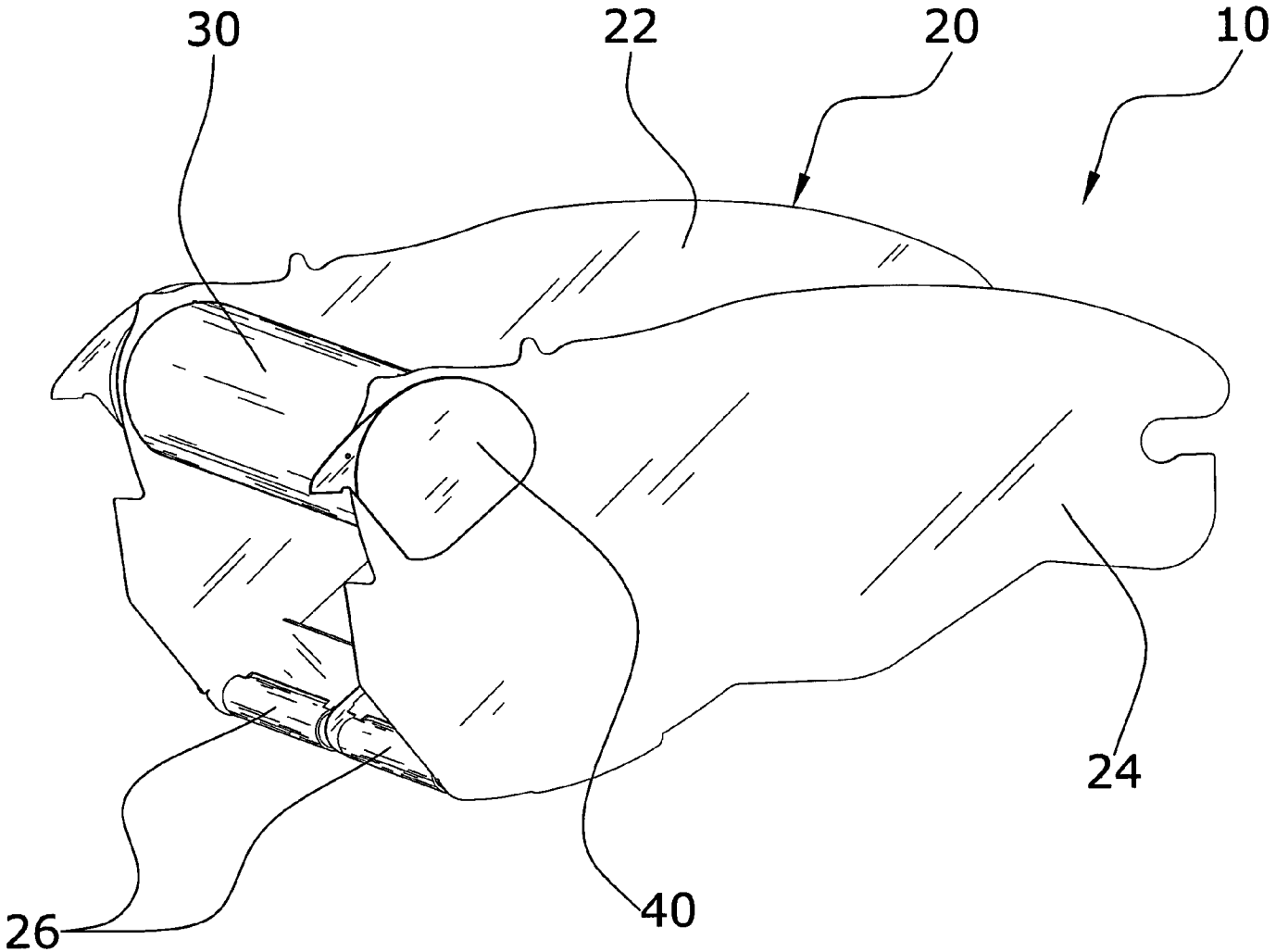
FIG. 1 is an upper perspective view of the present invention.

Turning now descriptively to the drawings, in which similar reference characters denote similar elements throughout the several views, FIGS. 1 through 8 illustrate a torque tube with slide out cage system 10, which comprises a torque tube 30 attached between a first side 22 and a second side 24 of a frame 20, a side opening within the frame 20 exposing the lumen 32 of the torque tube 30, and a support platform 50 slidably positioned within the torque tube 30. The support platform 50 is capable of supporting various types of control systems such as a valve box 12, hydraulic systems and electronics.

B. Frame

FIGS. 1 through 4 illustrate an exemplary frame 20 having a first side 22 and a second side 24. The frame 20 illustrated in FIGS. 1 through 4 should not in anyway limit the application of the present invention as the present invention may be utilized with respect to various types of frames 20 or machines.

The frame 20 is preferably part of a ground surface cleaning machine. As further shown in FIGS. 1 through 4, the frame 20 preferably includes one or more cross members 26 attached between the first side 22 and the second side 24 to provide additional support throughout the frame 20. U.S. Pat. No. 6,094,847 illustrates an exemplary ground surface cleaning machine suitable for usage with the present invention and is hereby incorporated by reference into this application.

C. Torque Tube

Figure 5:
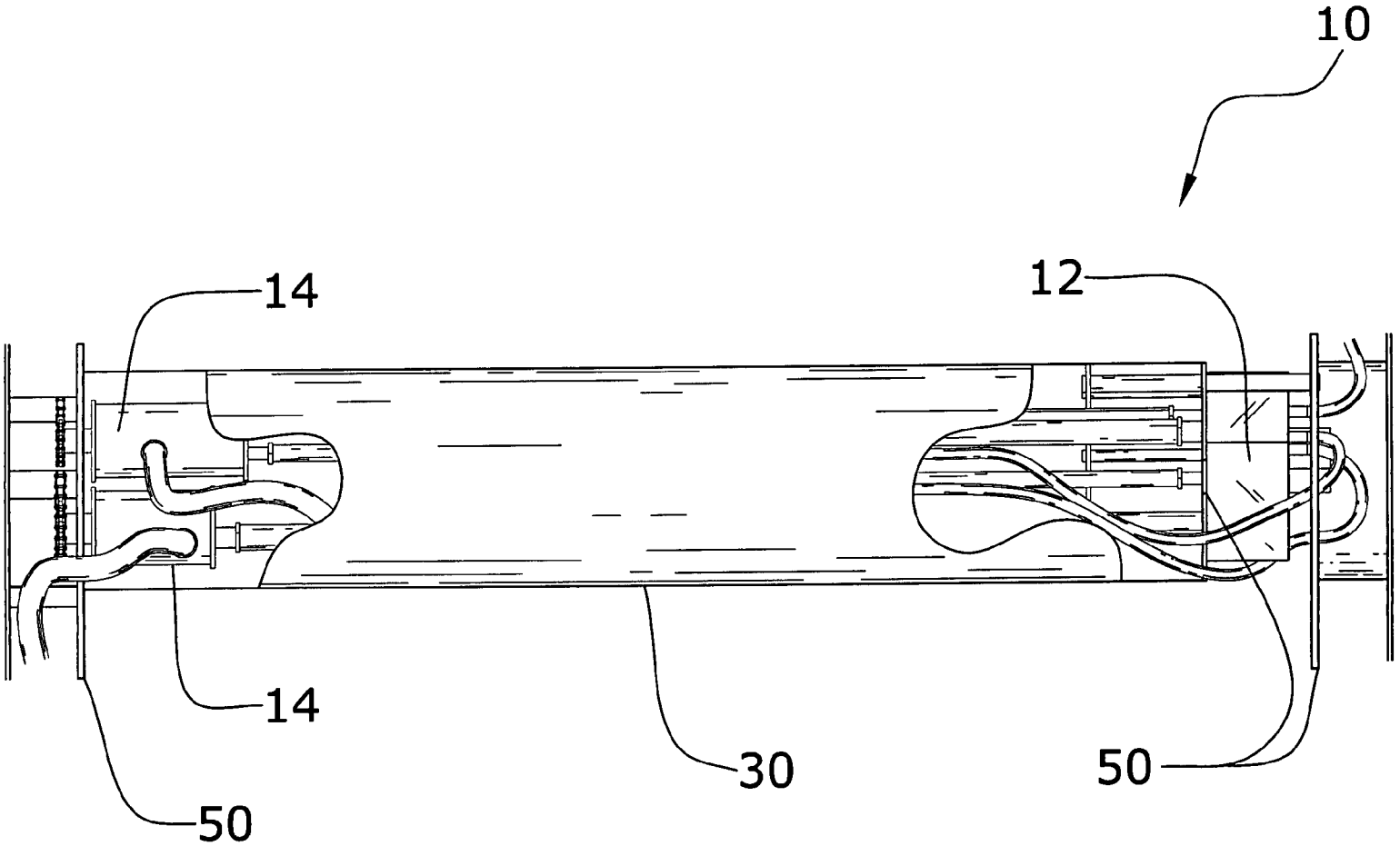
FIG. 5 is a front partial cutaway view of the present invention.
Figure 6:
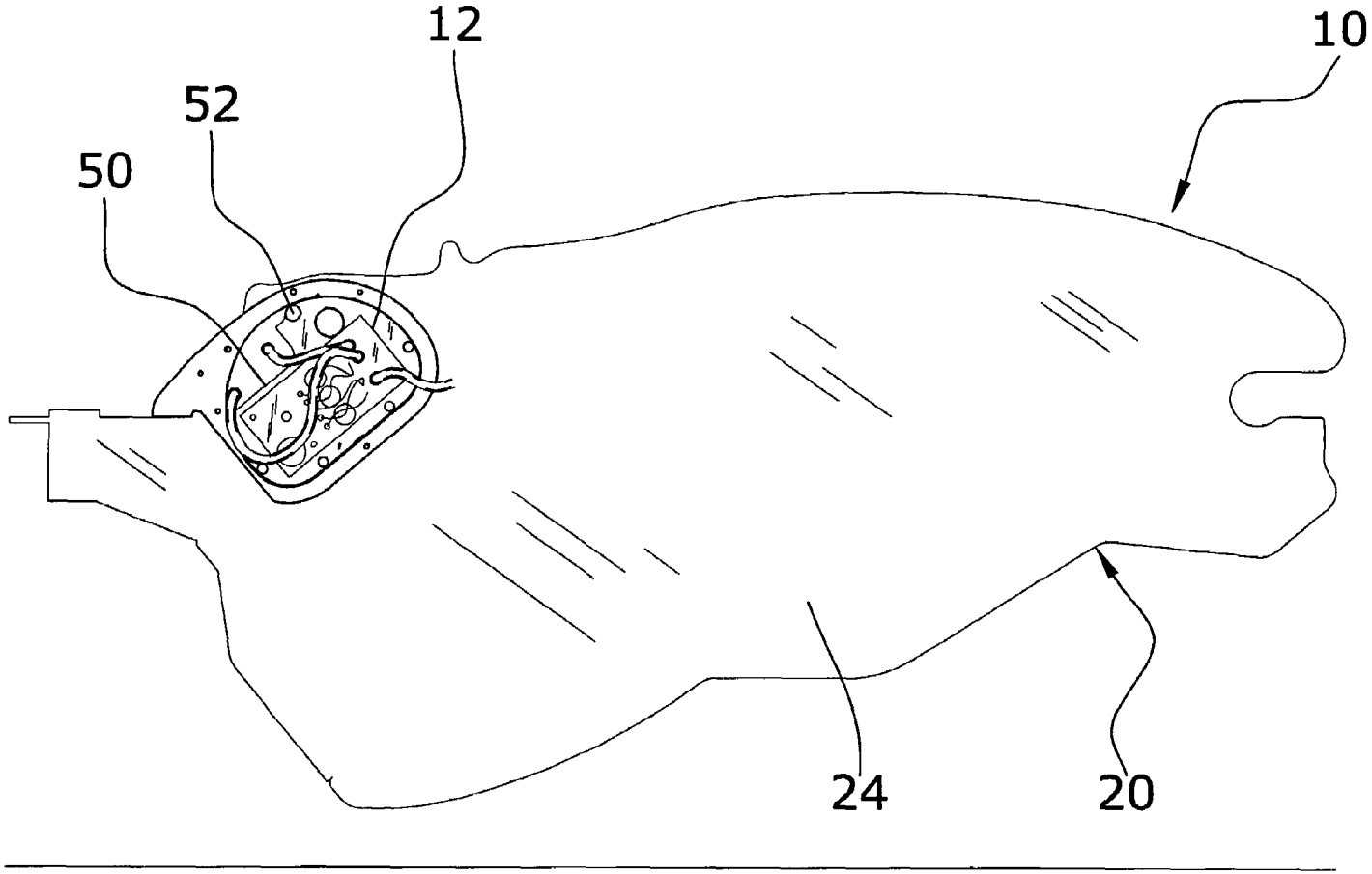
FIG. 6 is a side view of the present invention illustrating the side opening with the cage positioned within.
Figure 7:
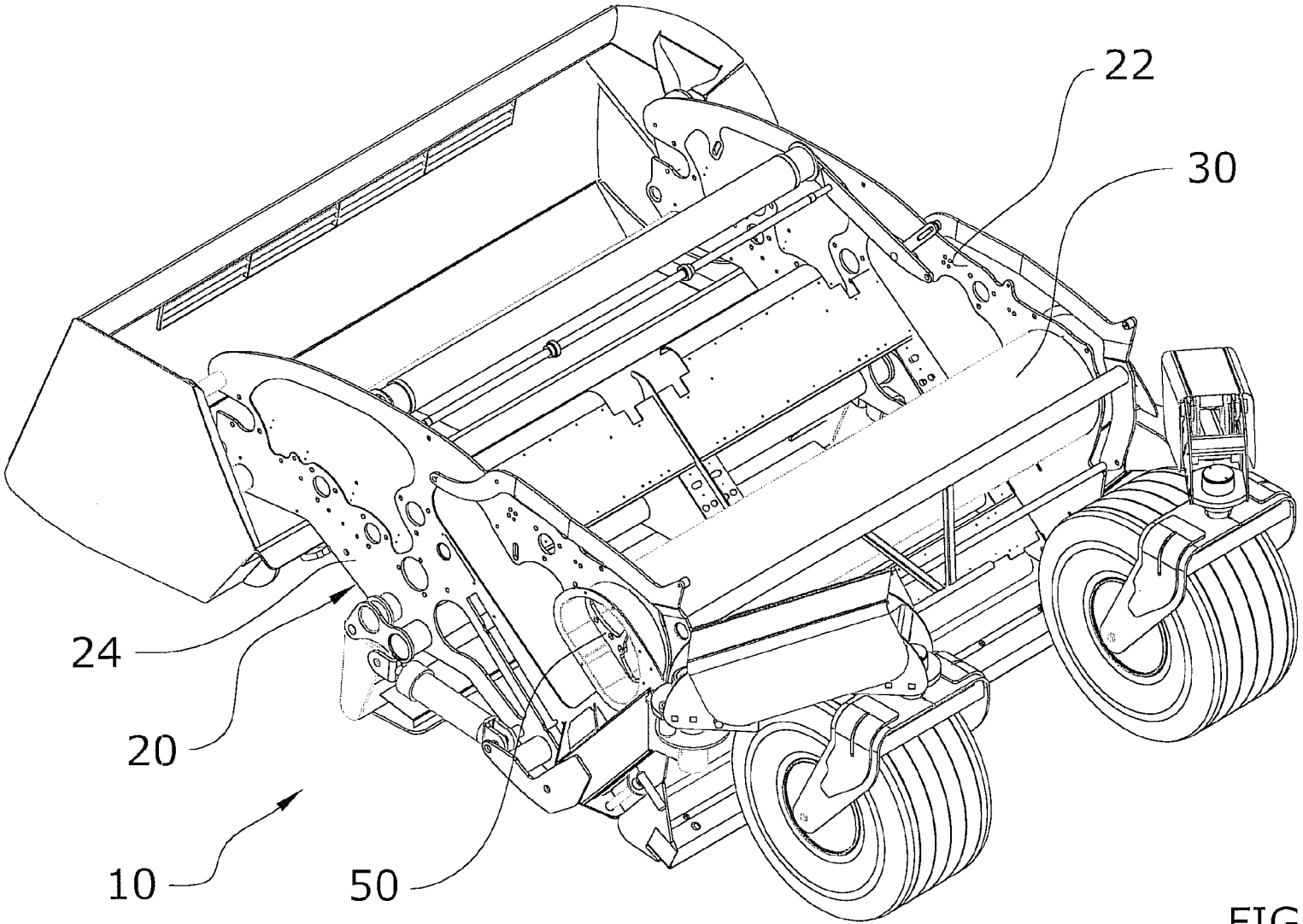
FIG. 7 is an upper perspective view of the present invention.
Figure 8:
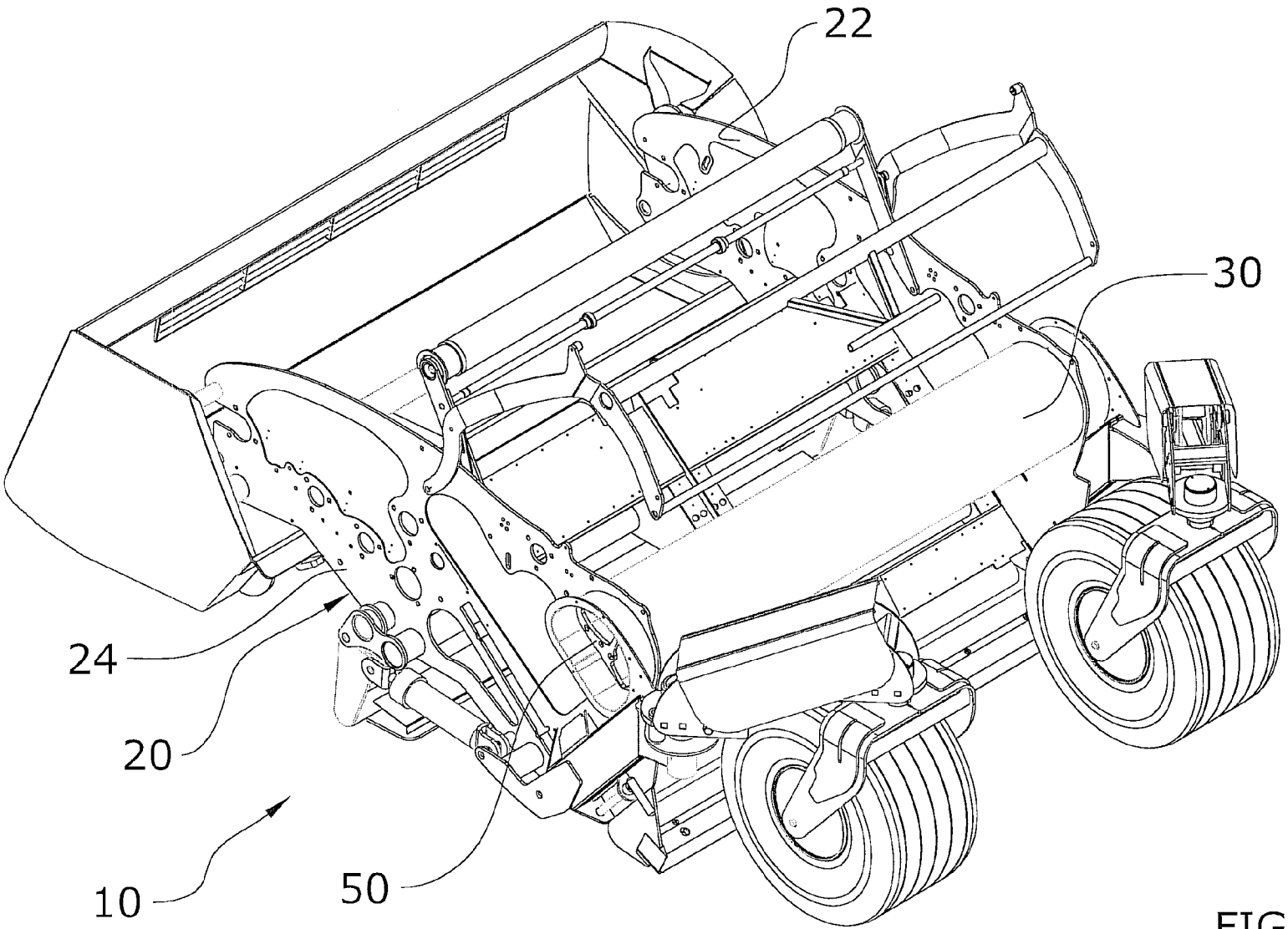
FIG. 8 is an upper perspective view of the present invention.

The torque tube 30 is comprised of an elongated rigid tubular structure having a lumen 32, a first end and a second end as illustrated in FIG. 5 of the drawings. The torque tube 30 preferably has a substantially circular shaped cross sectional area to provide for increased support between the first side 22 and the second side 24 of the frame 20. The torque tube 30 may have various other tubular cross sectional shapes capable of providing torsion support to the frame 20. Motors 14 and various other components of the control systems may be attached directly to the torque tube 30 as illustrated in FIG. 5 of the drawings.

The first end and the second end of the torque tube 30 are attached between the first side 22 and the second side 24 of the frame 20 respectively as illustrated in FIGS. 1 through 5 of the drawings. The torque tube 30 is preferably attached to the front portion of the frame 20 as shown in FIGS. 1 through 4 of the drawings, however, the torque tube 30 may be attached to various other locations within the frame 20 as can be appreciated.

Figure 2:
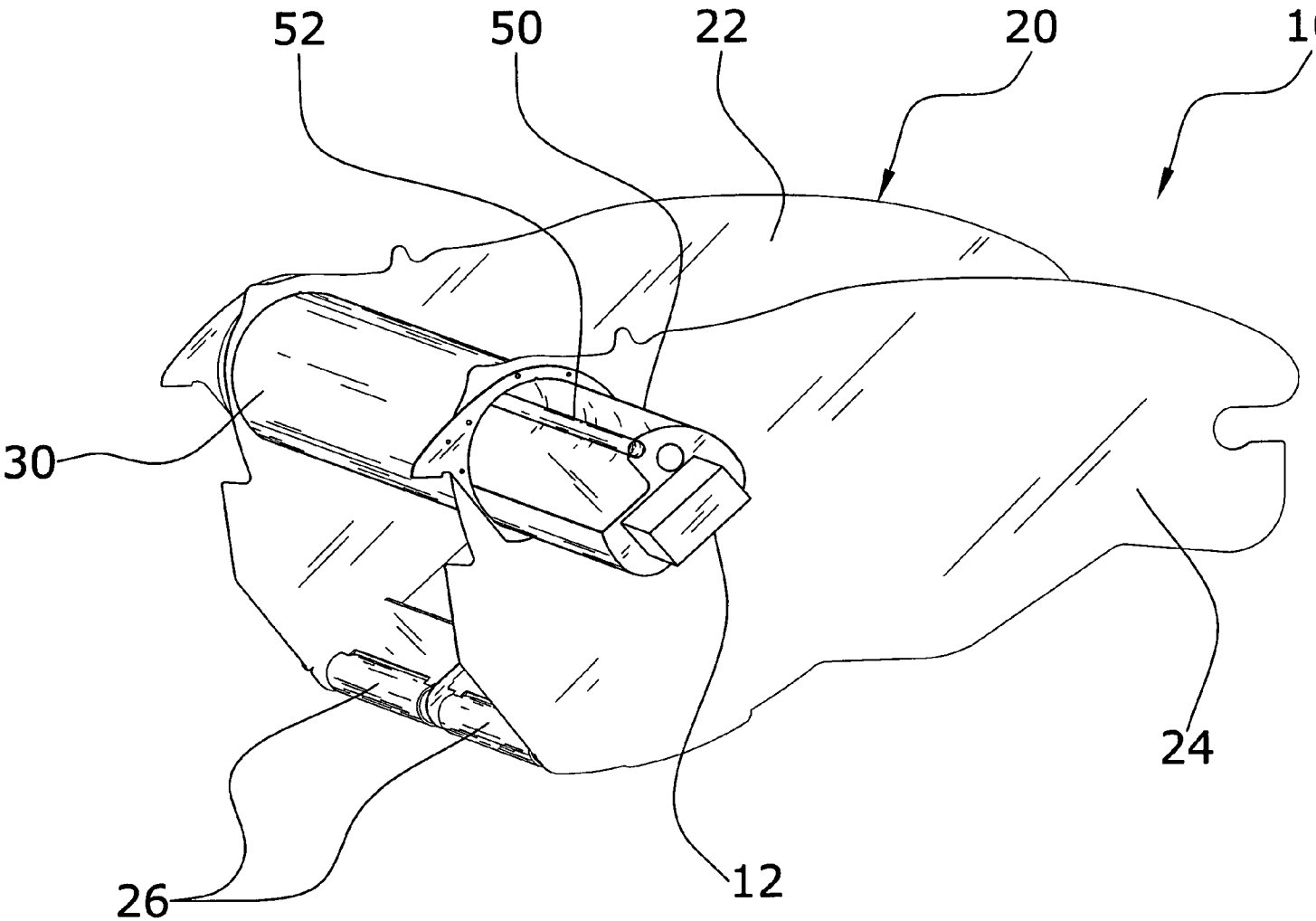
FIG. 2 is an upper perspective view of the present invention with the cage partially removed from the lumen of the torque tube.
Figure 3:
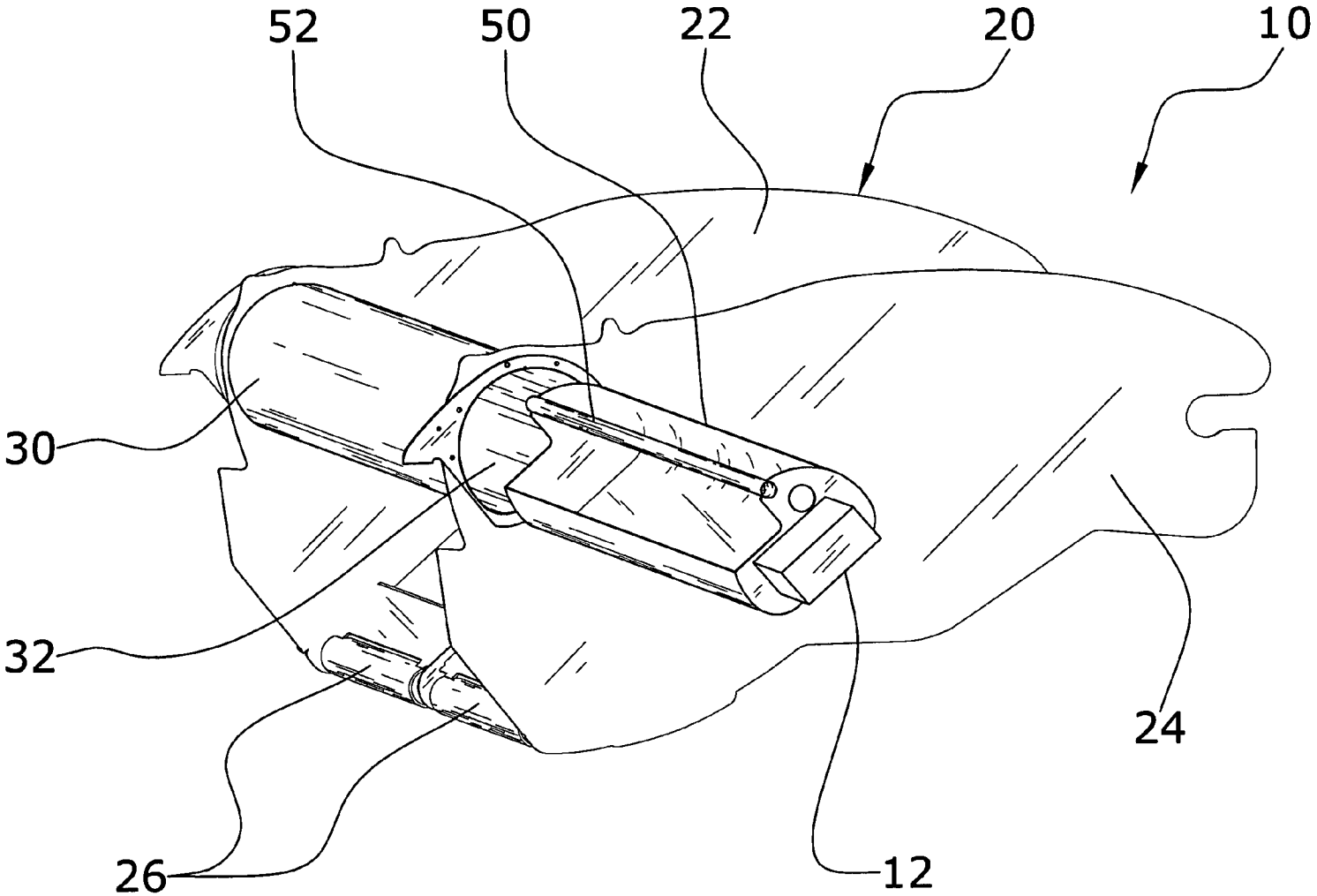
FIG. 3 is an upper perspective view of the present invention with the cage fully removed from the torque tube.
Figure 4:
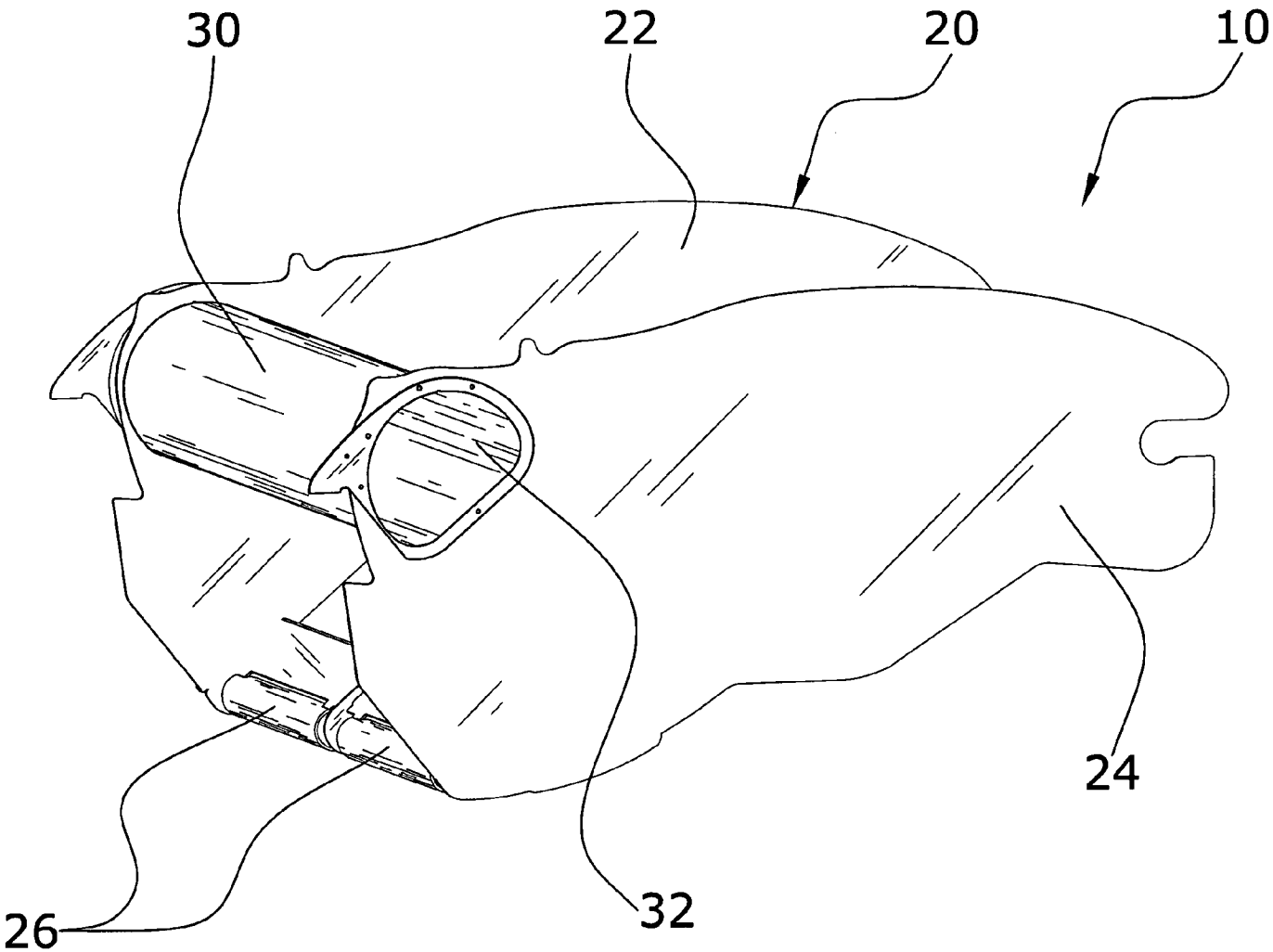
FIG. 4 is an upper perspective view illustrating the lumen of the torque tube.

As shown in FIGS. 3 and 4 of the drawings, a side opening extends within the frame 20 (either the first side 22 or the second side 24) exposing the lumen 32 of the torque tube 30 at one end thereof. The side opening allows for the support platform 50 to be extending into and from the torque tube 30 as illustrated in FIGS. 2 and 3 of the drawings. A cover 40 is removably attachable over the side opening within the frame 20 for protecting the lumen 32 and for maintaining the support platform 50 within the torque tube 30 as illustrated in FIG. 1 of the drawings.

D. Cage

The support platform 50 is slidably positioned within the torque tube 30 as best illustrated in FIGS. 2 and 3 of the drawings. The support platform 50 is capable of supporting various types of control systems (e.g. hydraulic systems, electrical systems) and their respective components (e.g. valve blocks, electrical control units, hoses, etc.). The control systems are utilized for operating the ground surface cleaning machine (e.g. for rotating the cleaning chains, lifting portions thereof, etc.).

The support platform 50 preferably includes a recessed portion which is exposed through an upper opening for receiving hoses and various other components of the control systems as best illustrated in FIGS. 2 and 3 of the drawings. The support platform 50 also preferably includes an upper support 52 extending between opposing ends of the support platform 50 as best illustrated in FIG. 3 of the drawings. The support platform 50 preferably extends at least half-ways through the torque tube 30, but the support platform 50 may be shorter or longer.

E. Operation of Invention

In use, the control systems for the ground surface cleaning machine are attached within the torque tube 30 and within the support platform 50 as illustrated in FIGS. 1 through 5 of the drawings. The user then operates the ground surface cleaning machine as they normally would for cleaning the ground surface of debris. During operation of the cleaning machine, the torque tube 30 provides structural and torsion support to the frame 20 while also protecting the control system components (e.g. motors 14, valve box 12, hoses, etc.) from moving debris (e.g. rocks). If one of the control system components requires repair, the user simply removes the cover 40 and then slides the support platform 50 out from the torque tube 30 to allow for the convenient repair of the components as illustrated in FIGS. 2 and 3 of the drawings.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A torque tube with slide out support platform system, comprising:

a frame having a first side and a second side;

a torque tube having a lumen, a first end and a second end, wherein said first end and said second end of said torque tube are attached between said first side and said second side of said frame respectively;

wherein said torque tube is non-movably attached to said frame;

a side opening within said first side of said frame exposing said lumen of the torque tube;

a support platform slidably positioned within the torque tube within said opening of said first side of said frame, wherein said support platform is capable of supporting various types of control systems;

a valve block attached to said support platform;

a hydraulic motor attached within said torque tube near said second end of said torque tube; and a plurality of hydraulic hoses fluidly connected between said valve block and said hydraulic motor, wherein said hydraulic hoses extend within said torque tube.

2. The torque tube with slide out support platform system of claim 1, wherein said frame is part of a ground surface cleaning machine.

3. The torque tube with slide out support platform system of claim 1, wherein said torque tube has an elongated tubular structure.

4. The torque tube with slide out support platform system of claim 1, wherein said torque tube has a substantially circular cross sectional area.

5. The torque tube with slide out support platform system of claim 1, wherein said support platform includes a recessed portion.

6. The torque tube with slide out support platform system of claim 1, wherein said support platform is comprised of a cage structure having an upper opening.

7. The torque tube with slide out support platform system of claim 1, wherein said support platform includes an upper support extending between opposing ends of said support platform.

8. The torque tube with slide out support platform system of claim 1, wherein said frame includes one or more cross members attached between said first side and said second side.

9. The torque tube with slide out support platform system of claim 1, wherein said plurality of hydraulic hoses have a sufficient amount of slack to allow said support platform to be at least partially removed from said torque tube.

10. A torque tube with slide out support platform system, comprising:

a frame having a first side and a second side;

a torque tube having a lumen, a first end and a second end, wherein said first end and said second end of said torque tube are attached between said first side and said second side of said frame respectively;

wherein said torque tube is non-movably attached to said frame;

a side opening within said first side of said frame exposing said lumen of the torque tube;

a support platform slidably positioned within the torque tube within said opening of said first side of said frame, wherein said support platform is capable of supporting various types of control systems;

a valve block attached to said support platform;

a hydraulic motor attached within said torque tube near said second end of said torque tube; and a plurality of hydraulic hoses fluidly connected between said valve block and said hydraulic motor, wherein said hydraulic hoses extend within said torque tube;

wherein said frame is part of a ground surface cleaning machine;

wherein said torque tube has an elongated tubular structure;

wherein said torque tube has a substantially circular cross sectional area;

wherein said plurality of hydraulic hoses have a sufficient amount of slack to allow said support platform to be at least partially removed from said torque tube.

* * * * *